US005905218A

United States Patent [19]

Chang

[11] Patent Number: 5,905,218

[45] Date of Patent: May 18, 1999

[54] DEVICE FOR CONNECTING TWO DRUM PEDALS OF A DRUM

[75] Inventor: Chi-Cheng Chang, Taichung Hsien, Taiwan

[73] Assignee: K.H.S. Musical Instrument Co., Ltd., Taiwan

[21] Appl. No.: 08/884,519

[22] Filed: Jun. 27, 1997

[51] Int. Cl.[6] ..... G10D 13/02

[52] U.S. Cl. ..... 84/422.1; 84/422.2

[58] Field of Search ..... 84/422.1, 422.2

[56] References Cited

U.S. PATENT DOCUMENTS 5,567,899 10/1996 Hoshino ..... 84/422.1

*Primary Examiner*—William M. Shoop, Jr.
*Assistant Examiner*—Shih-yung Hsieh
*Attorney, Agent, or Firm*—Hedman, Gibson & Costigan, P.C.

[57] ABSTRACT

A device for connecting two drum pedals of a drum includes an outer tube, an inner rod and a resilient strip. The outer tube defines therein an axial hexagonal (tetragonal) hole. A first end of the outer tube forms a recess on a periphery thereof having a plurality of screw holes and a through hole defined from a circumference of the outer tube to the outer surface of the recess. The inner rod is received in the hexagonal hole of the outer tube and defines a cutout in an appropriate position of a circumference thereof. The resilient strip is received in the recess of the outer tube and abuts the inner rod. A first end of the resilient strip has a protrusion integrally extending from one end thereof to be received in the through hole of the outer tube and a second end of the resilient strip is retained by the cutout of the inner rod. With this arrangement, the device for connecting two drum pedals can prevent damage to the inner rod and separation from the outer tube.

2 Claims, 5 Drawing Sheets

DEVICE FOR CONNECTING TWO DRUM PEDALS OF A DRUM

BACKGROUND OF THE INVENTION

1. Field of the Invention

The present invention relates to a device for connecting two drum pedals of a drum and, more particularly to a device for connecting two drum pedals of a drum which can prevent damage to an inner rod and separation from an outer tube thereof.

2. Description of Related Art

Drums have been popular musical instruments for thousands of years all over the world, and the bass drum has become particularly popular in modern music. A device for connecting two drum pedals of a drum is adopted to enable a performer to play the bass drum simultaneously with two feet, thereby leaving his/her hands free to play other drums. A conventional device for connecting two drum pedals of a bass drum generally has a structure as shown in FIG. 6 and FIG. 7. The connecting device includes an outer tube 60 and an inner rod 70. The outer tube 60 has a first end connected with one of two drum pedals via a linkage unit (not shown) which may be a cardan bearing. A second end of the outer tube 60 defines two radial screw holes 61. The outer tube 60 further defines an axial hexagonal (or tetragonal) hole 63 therein (see FIG. 7) for receiving inner rod 70 configured to mate therewith. A distal end of the inner rod 70 is mounted with a flexible sleeve 71 and defines a screw hole 73 therein. The flexible sleeve 71 also has a cardan bearing 72 disposed therein provided for connecting the inner rod 70 to the other of two drum pedals. In assembly, the inner rod 70 is inserted into the outer tube 60 from the second end thereof, leaving its distal end at an outside of the outer tube 60. Then two bolts 62 are respectively screwed into the two screw holes 61 of the outer tube 60 and abutted on a circumference of the inner rod 70, and a screw 74 is screwed into the screw hole 73 for securing the inner rod 70 to the other pedal.

Though this kind of device can connect two drum pedals of a drum, it has several disadvantages. Firstly, when the inner rod 70 is adjusted with respect to the outer tube 60, it may be separated from the outer tube 60 because there is no means for preventing the inner rod 70 from slipping away from the outer tube 60, and furthermore, it is difficult for the inner rod 70 to return to its original position during reassembly. Secondly, a tip portion of the bolt 62 abutting on the circumference of the inner rod 70 may result in damage to the inner rod 70.

The present invention provides an improved device connecting two drum pedals of a drum to mitigate and/or obviate the aforementioned problems.

SUMMARY OF THE INVENTION

One object of the present invention is to provide a device for connecting two drum pedals of a drum, which can prevent damage to an inner rod and separation from an outer tube thereof.

In accordance with one aspect of the present invention, a device for connecting two drum pedals of a drum includes an outer tube, an inner rod and a resilient strip. The outer tube defines therein an axial hexagonal (tetragonal) hole. A first end of the outer tube forms a recess on a periphery thereof having a plurality of screw holes and a through hole defined from a circumference of the outer tube to the outer surface of the recess. The inner rod is received in the hexagonal hole of the outer tube and defines a cutout in an appropriate position of a circumference thereof. The resilient strip is received in the recess of the outer tube and abuts the inner rod. A first end of the resilient strip has a protrusion integrally extending from one end thereof to be received in the through hole of the outer tube and a second end of the resilient strip is retained by the cutout of the inner rod.

In accordance with another aspect of the present invention, the first end of the resilient strip is mounted to the first end of the outer tube.

Other objects, advantages and novel features of the invention will become more apparent from the following detailed description when taken in conjunction with the accompanying drawings.

DETAILED DESCRIPTION OF PREFERRED EMBODIMENT

Figure 1:
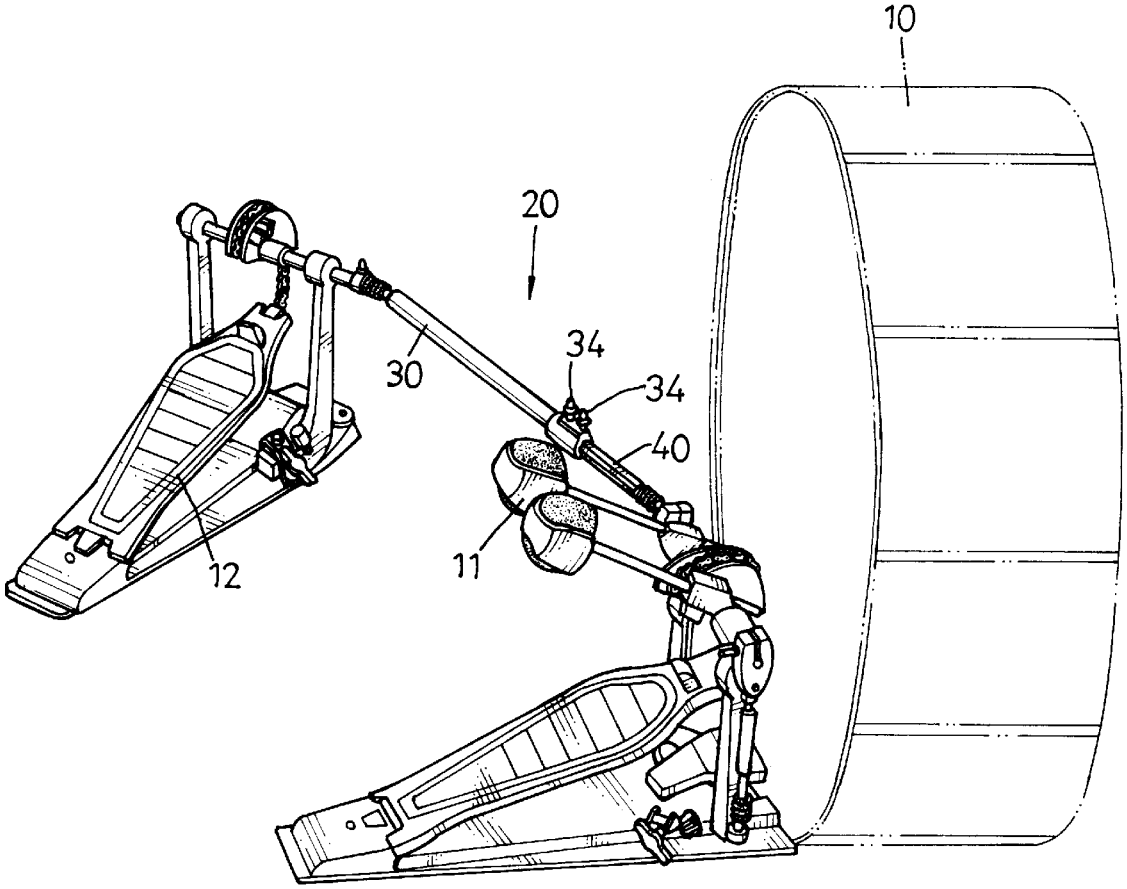
FIG. 1 is a perspective view showing a device for connecting two drum pedals of a drum in accordance with the present invention.

FIG. 1 is a perspective view showing a device 20 for connecting two drum pedals 12 of a drum 10 in accordance with the present invention. When the two drum pedals 12 are operated by a user, two drumsticks 11 pivotedly connected therewith will be driven by the device 20 to respectively or simultaneously hit the drum. The device 20 includes an outer tube 30 and an inner rod 40. The outer tube 30 has one end connected with one of two drum pedals 12 via a linkage unit (not numbered) which may be a cardan bearing.

Figure 2:
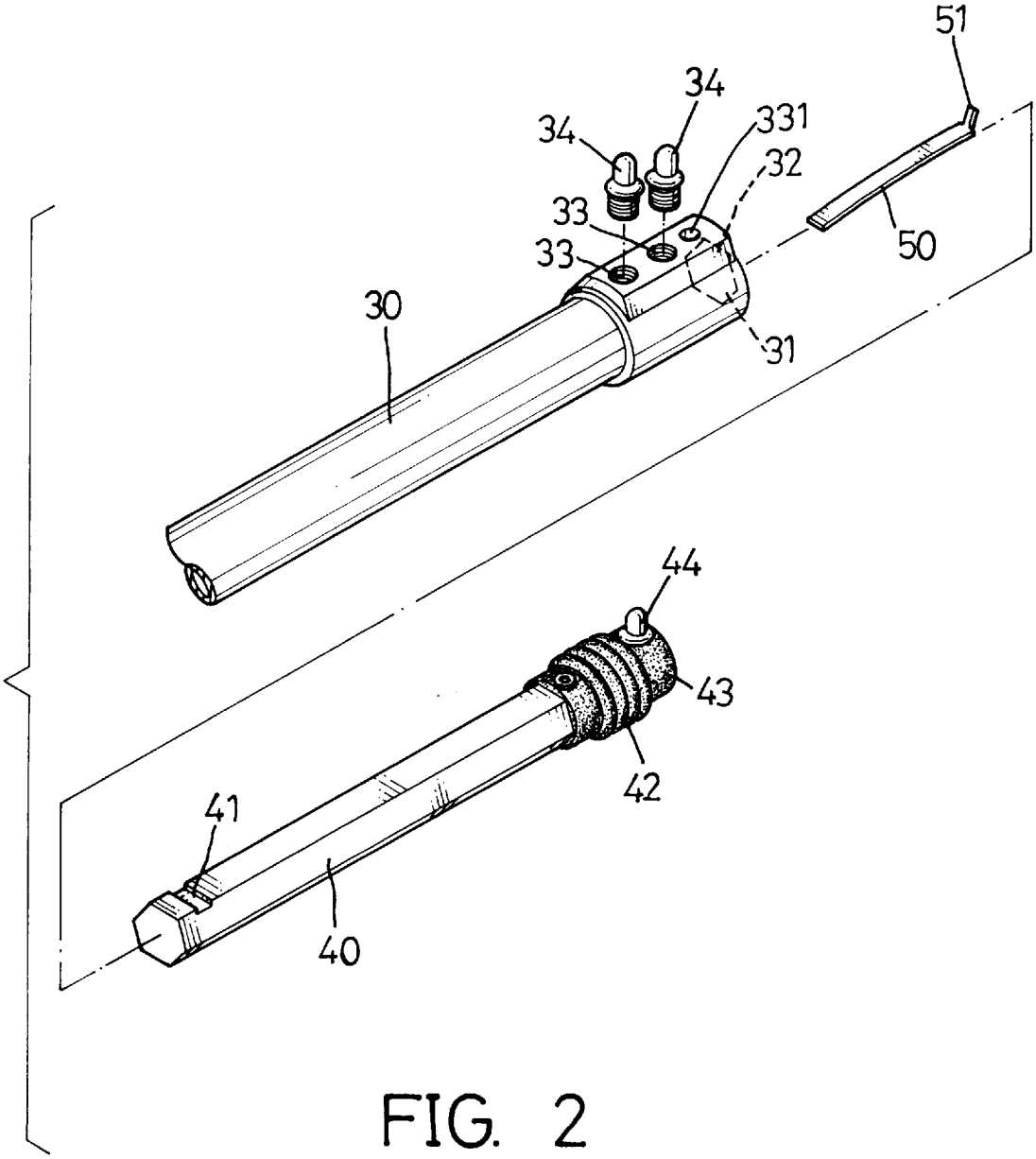
FIG. 2 is an exploded view showing elements of the device for connecting two drum pedals of FIG. 1.

Referring to FIG. 2, the outer tube 30 defines therein an axial hexagonal (tetragonal) hole 31. A first end of the outer tube 30 forms a recess 32 on a periphery thereof having two screw holes 33 and a through hole 331 defined from a circumference of the outer tube 30 to the outer surface of the recess 32. The inner rod 40 is received in the hexagonal hole 31 of the outer tube 30. The inner rod 40 defines a cutout 41 in an appropriate position of a circumference thereof. A resilient strip 50 is received in the recess 32 of the outer tube 30 and abuts the circumference of the inner rod 40. The resilient strip 50 is configured to slightly curve toward the inner rod 40. A first end of the resilient strip 50 has a protrusion 51 integrally extending therefrom to be received in the through hole 331 of the outer tube 30 and a second end of the resilient strip 50 is retained in the cutout 41 of the inner rod 40. Furthermore, a distal end of the inner rod 40 is mounted with a flexible sleeve 42. The flexible sleeve 42 also has a cardan bearing 43 disposed therein and a screw 44 for connecting the inner rod 40 to the other drum pedal 12.

Figure 3:
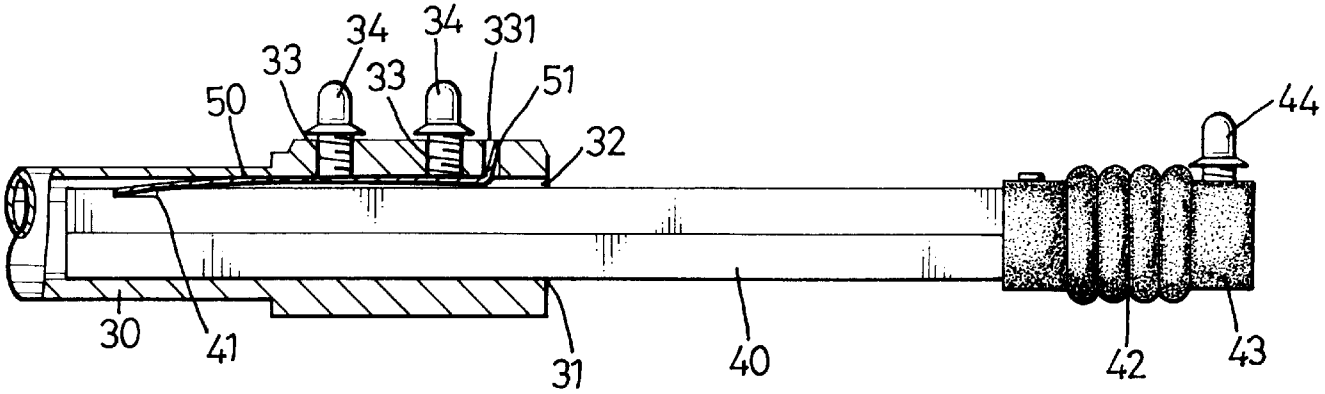
FIG. 3 is a longitudinal sectional view showing a first embodiment of the present invention.

In assembly, the resilient strip 50 is inserted into the recess 32 of the hexagonal hole 31 of the outer tube 30 so that the protrusion 51 thereof is received in the through hole 331 of the outer tube 30. Then the inner rod 40 is inserted into the first end of the outer tube 30, leaving its distal end at an outside of the outer tube 30. Thereafter, two bolts 34 are respectively screwed into the two screw holes 33 of the outer tube 30 to retain a surface of the resilient strip 50, as shown in FIG. 3.

When the inner rod 40 is adjusted with respect to the outer tube 30, at an extreme position, the second end of the resilient strip 50 will be retained by the cutout 41 of the inner rod 40, thereby preventing a separation of the inner rod from the outer tube 30. Also, the bolts 34 of the connecting device 20 retain the surface of the resilient strip 50 rather than the circumference of the inner rod 40 so damage to the inner rod 40 can be avoided.

Figure 4:
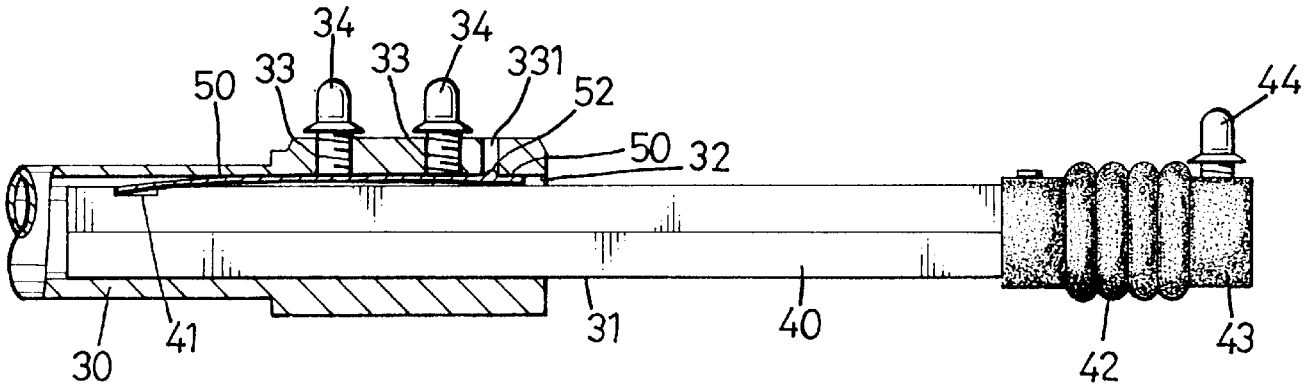
FIG. 4 is a longitudinal sectional view showing a second embodiment of the present invention.
Figure 5:
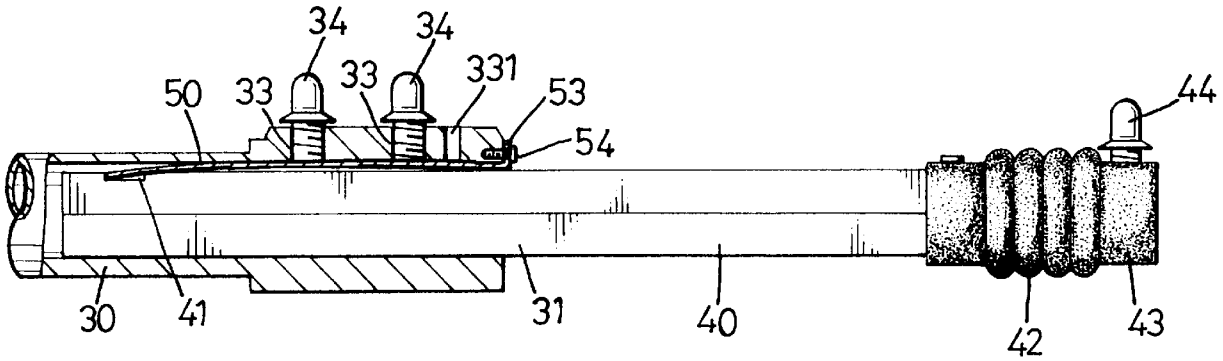
FIG. 5 is a longitudinal sectional view showing a third embodiment of the present invention.
Figure 7:
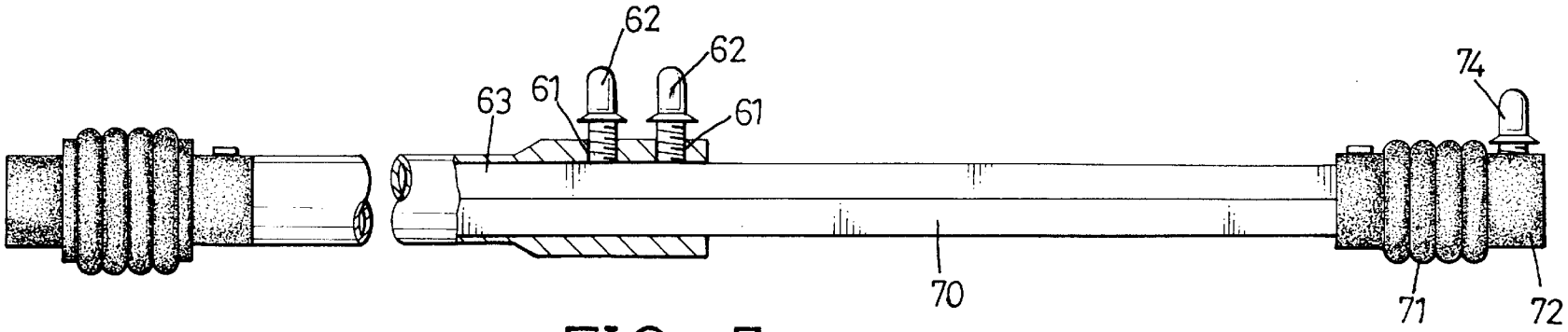
FIG. 7 PRIOR ART
FIG. 7 is a longitudinal sectional view showing a combined structure of the conventional device for connecting two drum pedals.
Figure 6:
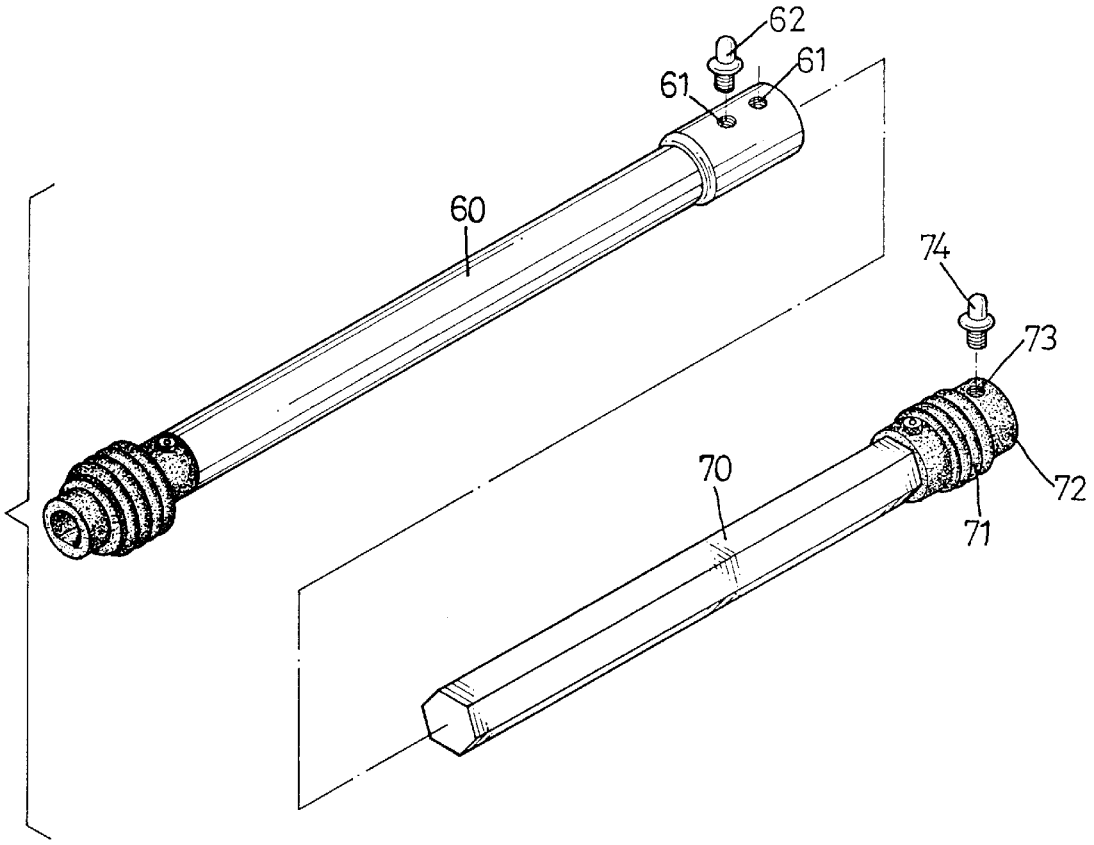
FIG. 6 PRIOR ART
FIG. 6 is an exploded view showing elements of a conventional device for connecting two drum pedals.

FIG. 4 and FIG. 5 are longitudinal sectional views respectively showing a second and a third embodiment of the present invention. In FIG. 4, at the first end of the resilient strip 50, a boss 52 is configured to be received in the through hole 331 of the outer tube 30. In FIG. 5, the first end of the resilient strip 50 is mounted to the outer tube 30 by a screw 54. It is appreciated that the second and third embodiment can obtain the same effect as the first embodiment of this invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A device for connecting two drum pedals of a drum comprising:

an outer tube defining therein an axial hole, a first end of the outer tube forming a recess on a periphery thereof having a plurality of screw holes and a through hole defined from a circumference of the outer tube to the recess;

an inner rod received in the hole of the outer tube, said inner rod defining a cutout in a circumference thereof; and a resilient strip received in the recess of the outer tube and abutting the inner rod, a first end of said resilient strip having a protrusion integrally extending therefrom to be received in the through hole of the outer tube and a second end of said resilient strip retained by the cutout of the inner rod.

2. A device for connecting two drum pedals of a drum as claimed in claim 1, wherein said first end of the resilient strip is mounted to the first end of the outer tube.

* * * * *